US005470623A

United States Patent [19]

Lucas

[11] Patent Number: 5,470,623

[45] Date of Patent: Nov. 28, 1995

[54] DECORATIVE PANEL HAVING ADHESIVELY SET AND ARBITRARILY POSITIONED POLYGONAL MOSAIC ELEMENTS

[75] Inventor: Jacques Lucas, Briare, France

[73] Assignee: Emaux de Briare Technologies, S.A., Briare, France

[21] Appl. No.: 984,503

[22] Filed: Dec. 2, 1992

[30] Foreign Application Priority Data

Dec. 11, 1991 [FR] France ..... 91 15378

[51] Int. Cl.[6] ..... B44C 1/28

[52] U.S. Cl. ..... 428/47; 52/311.2; 428/60; 428/192; 428/255

[58] Field of Search ..... 428/47, 48, 49, 428/13, 14, 33, 60, 192, 255; 52/311.2

[56] References Cited

U.S. PATENT DOCUMENTS

| | | | |
|---|---|---|---|
| 1,853,824 | 4/1932 | Krauss | 428/47 X |
| 4,129,671 | 12/1978 | Greenberg | 428/49 X |
| 4,177,305 | 12/1979 | Feingold et al. | 428/47 X |
| 4,415,616 | 11/1983 | Angioletti | 428/47 X |
| 4,620,998 | 11/1986 | Lalvani | 428/47 X |
| 4,735,437 | 4/1988 | Fattibene | 428/43 X |
| 5,041,317 | 8/1991 | Greyvenstein | 428/43 X |

FOREIGN PATENT DOCUMENTS

| | | | |
|---|---|---|---|
| 305562 | 3/1989 | European Pat. Off. . | |
| 1326490 | 4/1963 | France | 428/49 |
| 3328528 | 6/1985 | Germany | 428/49 |

OTHER PUBLICATIONS

Patent Abstracts of Japan, (M-1062) Dec. 20, 1990 & JP-A-2 248 569 (Sekaicho Rubber Co., Ltd.) Oct. 4, 1990.

*Primary Examiner*—Henry F. Epstein
*Attorney, Agent, or Firm*—Pollock, Vande Sande & Priddy

[57] ABSTRACT

A device making it possible to install tiles or any other decorative design in the form of a panel, particularly on walls or floors, wherein these decorative designs are laid down and adhere by adhesive prebonding on a mesh consisting of a trellis of filaments, the said panels are formed of two parts, an external polygon consisting of mosaics arranged in rigorously defined positions which determine the manner in which the panels fit together, and a random arrangement inside the said polygon or frame with a density of mosaics or stones such that they do not touch and do not form any alignment, the juxtaposition of the said panels formed in this way provides a final appearance devoid of connection joint lines.

3 Claims, 1 Drawing Sheet

FIG. 1
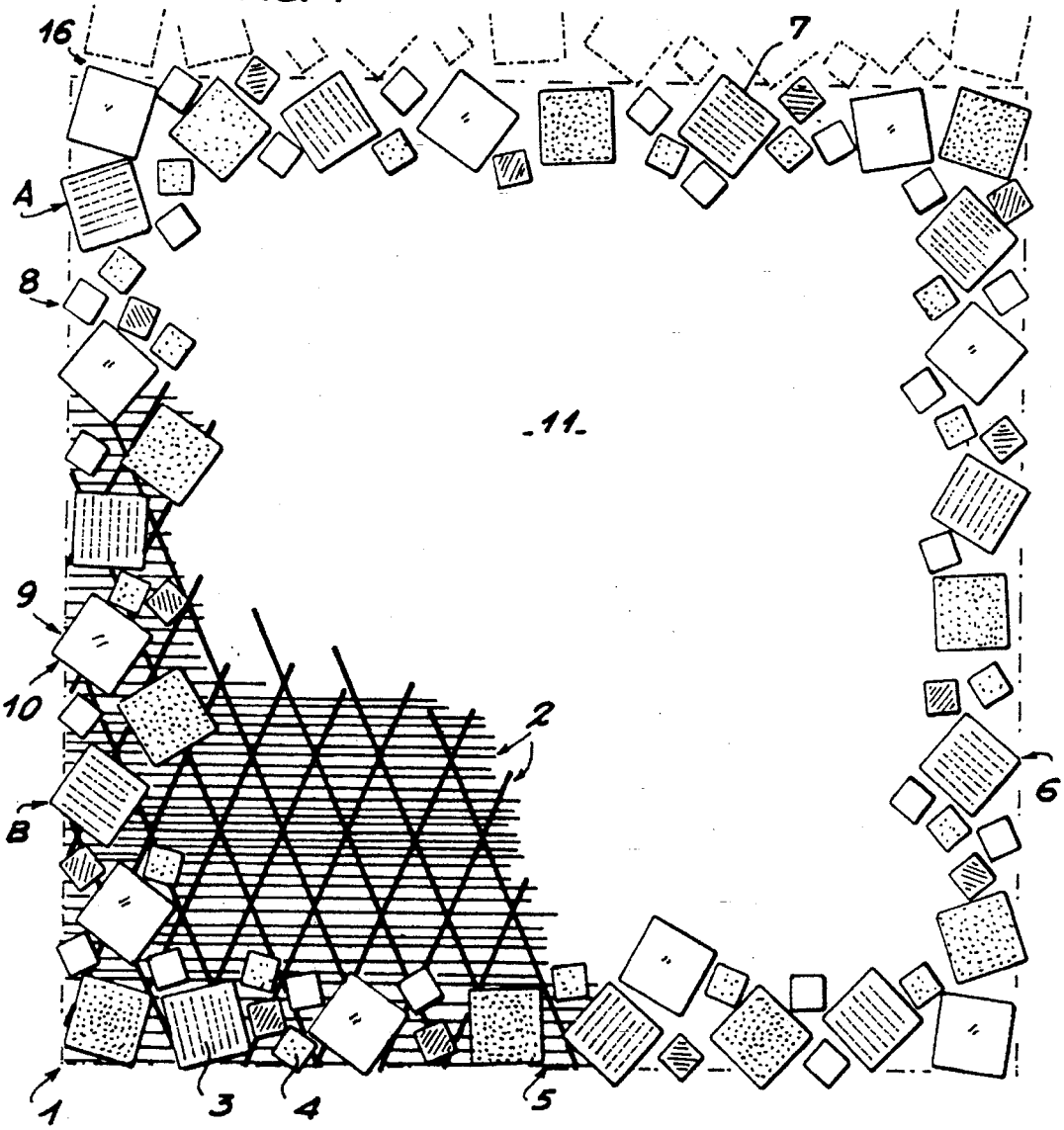
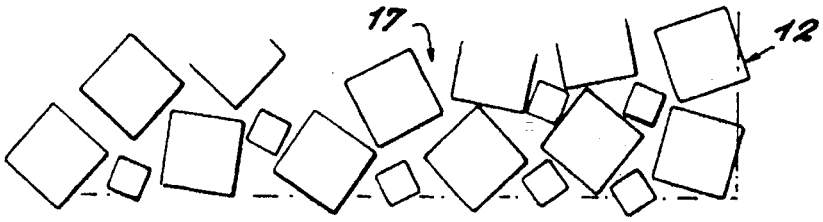
FIG. 2
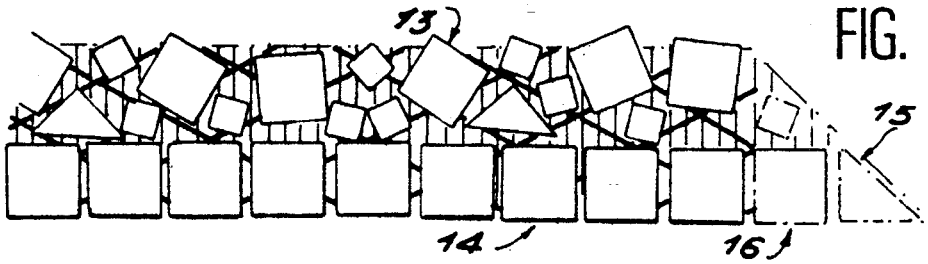
FIG. 3

DECORATIVE PANEL HAVING ADHESIVELY SET AND ARBITRARILY POSITIONED POLYGONAL MOSAIC ELEMENTS

FIELD OF THE INVENTION

The present invention relates to a device which, by using panels having standard dimensions and shapes, comprising a series of tiles or decorative motifs which have been previously placed and secured by known means (adhesive bonding) on a mesh, enables the person skilled in the art to produce a large number of square meters of covered surface in a short time while preserving, over the whole area of the wall or floor, a uniform and even spacing between the geometrical designs.

BRIEF DESCRIPTION OF THE INVENTION

These applications are numerous and varied, both in the domestic and the industrial fields.

The method for preparing these panels of ceramic tiles uses designs having a simple shape such as in particular circles or polygons, placed on paper or a mesh made of plastic or paper by adhesive-bonding means in a strict manner; they form horizontal and vertical alignments, the person skilled in the art juxtaposes these panels edge to edge, forming in this way a uniform surface which does not expose the connection joint lines.

The major disadvantage of this existing device is that it is confined to panels on which the decorative designs are placed and secured on a grid in a rigorous manner, their outline defines horizontal and vertical lines or undulations which all nevertheless have axes or planes of symmetry .thus guaranteeing a uniform end product when these panels are juxtaposed.

The original feature of the device forming the subject of the invention is to enable a similar result to be obtained, but from an arrangement of decorative designs placed in a random manner on a mesh made of synthetic material or on paper or paper mesh.

The subject of the invention is therefore a device making it possible to install tiles or any other decorative design in the form of a panel, particularly on walls or floors, characterized in that these decorative designs are laid down and adhere by adhesive prebonding on a mesh consisting of a trellis of filaments made, for example, of plastic, paper or paper mesh, the said panels are formed of two parts, an external polygon consisting of mosaics arranged in rigorously defined positions which determine the manner in which the panels fit together, and a random arrangement inside the said polygon or frame with a density of mosaics or stones such that they do not touch and do not form any alignment, the juxtaposition of the said panels formed in this way provides a final appearance devoid of connection joint lines.

Other characteristics and advantages of the present invention will emerge from the following description, given with reference to the attached drawings which illustrate a non-limiting embodiment thereof.

BRIEF DESCRIPTION OF THE DRAWINGS

In the figures:

FIG. 1 is a plan view of the device for preparing a ceramic tile panel.

FIG. 2 is a plan view of the random arrangement intended for the internal space of the frame.

FIG. 3 is a plan view of the external finishing border.

DETAILED DESCRIPTION OF THE INVENTION

According to a preferred embodiment of this device for preparing panels of ceramic stones or tiles, a frame 1 or polygon of decorative designs 3, 4 is prepared on the base of a mesh 2 made of flexible plastic paper or paper mesh, which decorative designs adhere by a known means, in particular by adhesive bonding, to the openwork support 2 and are placed in such a way that the edges 9, 10 of the designs 3, 4 protrude outwards and are neither parallel nor perpendicular to the sides of the polygon 5, 6, 7, 8. The sides of the polygon are similar in every respect: dimensions, appearance and configuration of the stones. These predefined frames comprise, in the internal space 11, a set of decorative designs similar to the preceding ones, also placed on the flexible mesh 2 by adhesive bonding and in the form of a random arrangement 12. The said internal space 11 is filled with a plurality of stones having different shapes and sizes, however a space 17 is kept around the whole periphery for the subsequent finishing joint, and the addition of at least one stone creates the beginning of an alignment which is undesirable. The edges of the polygon 5, 6, 7, 8 may possibly be divided into two parts A and B of equal length which also have a configuration which is identical to the said sides. The total surface is assembled by juxtaposing panels according to this device, either edge to edge or head to foot, the jagged profiles and possibly the half-profiles A or B fitting into each other in such a way that the remaining space between panels is no greater than the gap 17 between mosaics existing when the panels are constructed. A finishing border 16 is formed according to the same method for preparing the said panels; one of the sides 13 has the same external jagged outline as a said panel; the other 14 consists of a row of aligned stones; the ends of these borders 14 are right-angled or possibly bevelled 15; this assembly provides a linear finish.

It will be clear on reading the preceding description that the invention relates to a novel system in the use of prefabricated panels formed from decorative designs placed with random orientation, which enables the person skilled in the art to cover a large surface such as in particular a wall and floor, devoid of any connection lines, in the industrial and domestic fields. He produces in this way a uniform area without any axis or plane of symmetry.

It of course remains the case that the present invention is not limited to the embodiments described and depicted above, but that it encompasses all the variants thereof.

I claim:

1. A tile mosaic panel comprising:

a mesh base for mounting tiles and having longitudinal and transverse edges thereon;

polygonal tiles mounted in coplanar relation on the base and in non-orthogonal relation to the edges;

a number of the tiles located inwardly of the edges being arranged arbitrarily on the mesh base; and a number of the tiles disposed along each edge arranged in a respective repeating pattern and partially overhanging a corresponding edge to form a jagged edge that meshes with an abutting jagged edge of an adjacently situated panel so as to conceal joint therebetween.

2. The panel set forth in claim 1 together with at least one border panel butted against an edge of the mosaic panel, the border panel having:

a polygonal mesh border base for mounting tiles;

tiles mounted in coplanar relation on the polygonal mesh base;

a number of the tiles disposed along a first longitudinal edge of the border base arranged in a predetermined pattern and partially overhanging the first edge to form a jagged edge that meshes with an abutting jagged edge of an adjacently situated mosaic panel so as to conceal a joint therebetween; and an opposite second longitudinal edge having a number of the tiles arranged in alignment thereby presenting a straight border to abutting mosaic and border panels.

3. The border panel set forth in claim 2 wherein the border panel includes at least one bevelled transverse edge for allowing right angled border panels to frame the mosaic panels.

* * * * *